US012570440B2

(12) United States Patent
Tseng et al.

(10) Patent No.: US 12,570,440 B2
(45) Date of Patent: Mar. 10, 2026

(54) SELECTIVELY SIZABLE BAG

(71) Applicant: Inteplast Group Corporation, Livingston, NJ (US)

(72) Inventors: Pai-Mei Tseng, Somerset, NJ (US); Jyh-Yao Raphael Li, Parsippany, NJ (US)

(73) Assignee: INTEPLAST GROUP CORPORATION, Livingston, NJ (US)

( * ) Notice: Subject to any disclaimer, the term of this patent is extended or adjusted under 35 U.S.C. 154(b) by 99 days.

(21) Appl. No.: 18/299,331

(22) Filed: Apr. 12, 2023

(65) Prior Publication Data

US 2024/0343451 A1 Oct. 17, 2024

(51) Int. Cl.
*B65D 33/25* (2006.01)

(52) U.S. Cl.
CPC ..... *B65D 33/2566* (2013.01)

(58) Field of Classification Search
CPC ..... B65D 33/2566
USPC ..... 383/2, 63, 82, 83, 88, 89, 90
See application file for complete search history.

(56) References Cited

U.S. PATENT DOCUMENTS 909,248 A * 1/1909 Staeger ..... A45C 7/0063 383/15
1,426,485 A * 8/1922 La Roche ..... A45C 7/0063 150/110
1,537,956 A * 5/1925 Mcnally ..... A45C 3/00 D3/274
2,080,252 A * 5/1937 Cook ..... D06F 95/004 383/92
2,927,617 A * 3/1960 Kurzrock ..... A45C 7/0072 383/2
4,665,557 A * 5/1987 Kamp ..... B65D 33/2508 24/339
4,679,242 A * 7/1987 Brockhaus ..... A45C 7/0059 383/18
4,706,297 A * 11/1987 Ausnit ..... B65D 33/2508 383/122
5,540,366 A * 7/1996 Coomber ..... A45F 3/00 224/664
5,816,709 A * 10/1998 Demus ..... A45C 11/22 383/88
6,234,675 B1 5/2001 Saad et al.
6,579,008 B2 6/2003 Price et al.
7,137,736 B2 11/2006 Pawloski et al.
7,344,022 B2 * 3/2008 Madson ..... B65D 31/10 383/88
7,556,429 B2 7/2009 Taheri
7,850,368 B2 12/2010 Pawloski et al.
7,866,011 B2 1/2011 Greco et al.
(Continued)

FOREIGN PATENT DOCUMENTS

DE 202008005505 U1 * 10/2008 ..... A45C 13/10
KR 20220012103 A * 2/2022

OTHER PUBLICATIONS

Machine translation of KR-20220012103-A. (Year: 2022).*
Machine translation of DE-202008005505-U1. (Year: 2008).*

*Primary Examiner* — Jes F Pascua
(74) *Attorney, Agent, or Firm* — Stinson LLP

(57) ABSTRACT

A polymeric bag for storing items. The bag includes connector elements that can be connected together at different locations. The connection of the connector elements effectively reduces the volume of the bag so that it can more closely conform to the item stored in the back.

10 Claims, 4 Drawing Sheets

(56) References Cited

U.S. PATENT DOCUMENTS

| | | | | |
|---|---|---|---|---|
| 8,209,995 | B2 * | 7/2012 | Kieling ..... | A45C 3/001<br>383/110 |
| 10,106,297 | B2 | 10/2018 | Chang et al. | |
| 2008/0285897 | A1 | 11/2008 | Taheri | |
| 2016/0096659 | A1 | 4/2016 | Bielke et al. | |

* cited by examiner

SELECTIVELY SIZABLE BAG

FIELD

The present disclosure generally relates to flexible bags and, in particular, a bag that can be selectively sized.

BACKGROUND

The use of polymeric bags for holding and storing items in a relatively air-tight manner is well known. The elimination of air from the bag is an important factor in preserving items that can spoil, such as food items. Even though air-tight seals of a bag can be achieved, the volume of the bag containing the item is often much larger than the item contained, leaving significant volume in the bag in which air can reside.

SUMMARY

In one aspect, a selectively sizeable polymeric bag generally comprises a first sheet of polymeric material having an interior surface and an exterior surface, and a second sheet of polymeric material having an interior surface and an exterior surface. The second sheet of polymeric material is arranged so that the interior surface of the second sheet of polymeric material faces toward the interior surface of the first sheet of polymeric material. The second sheet of polymeric material being operatively connected to the first sheet of material to form a bag volume. The first and second sheets of material have an opening at one end for receiving one or more articles into the bag volume. A first connector element is mounted on one of the first and second sheets of polymeric material. Plural second connector elements are each configured to mate with the first connector element to hold the second connector element in releasable connection with the first connector element. The second connector elements are mounted on at least one of the exterior surface of the second sheet of polymeric material and the exterior surface of the first sheet of polymeric material at spaced apart locations. The first and second flexible sheets of polymeric material are flexible to bring the first connector element into mating engagement with any one of the second connector elements for use in selectively conforming the bag volume to a volume of the one or more articles held in the bag.

In another aspect, a selectively sizeable polymeric bag generally comprises a first sheet of polymeric material having an interior surface and an exterior surface, and a second sheet of polymeric material having an interior surface and an exterior surface. The second sheet of polymeric material is arranged so that the interior surface of the second sheet of polymeric material faces toward the interior surface of the first sheet of polymeric material. The second sheet of polymeric material is operatively connected to the first sheet of material to form a bag volume. The first and second sheets of material have an opening at one end for receiving items into the bag volume. The first sheet of polymeric material includes a flap extending beyond the opening formed by the first and second sheets of polymeric material. A first closure element is located on an interior surface of the first sheet of polymeric material proximate the opening. A second closure element on an interior surface of the second sheet of polymeric material is located proximate the opening, and the second closure element is selectively mateable with the first closure element for closing the opening. A first connector element is located on the flap of the first sheet of polymeric material, and a second connector element is located on the exterior surface of at least one of the first and second sheets of polymeric material. The first connector element is configured for selective connection to any one of the second connector elements. The second connector elements are arranged so that the bag volume changes upon connection of the first connector element to different ones of the second connector elements.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
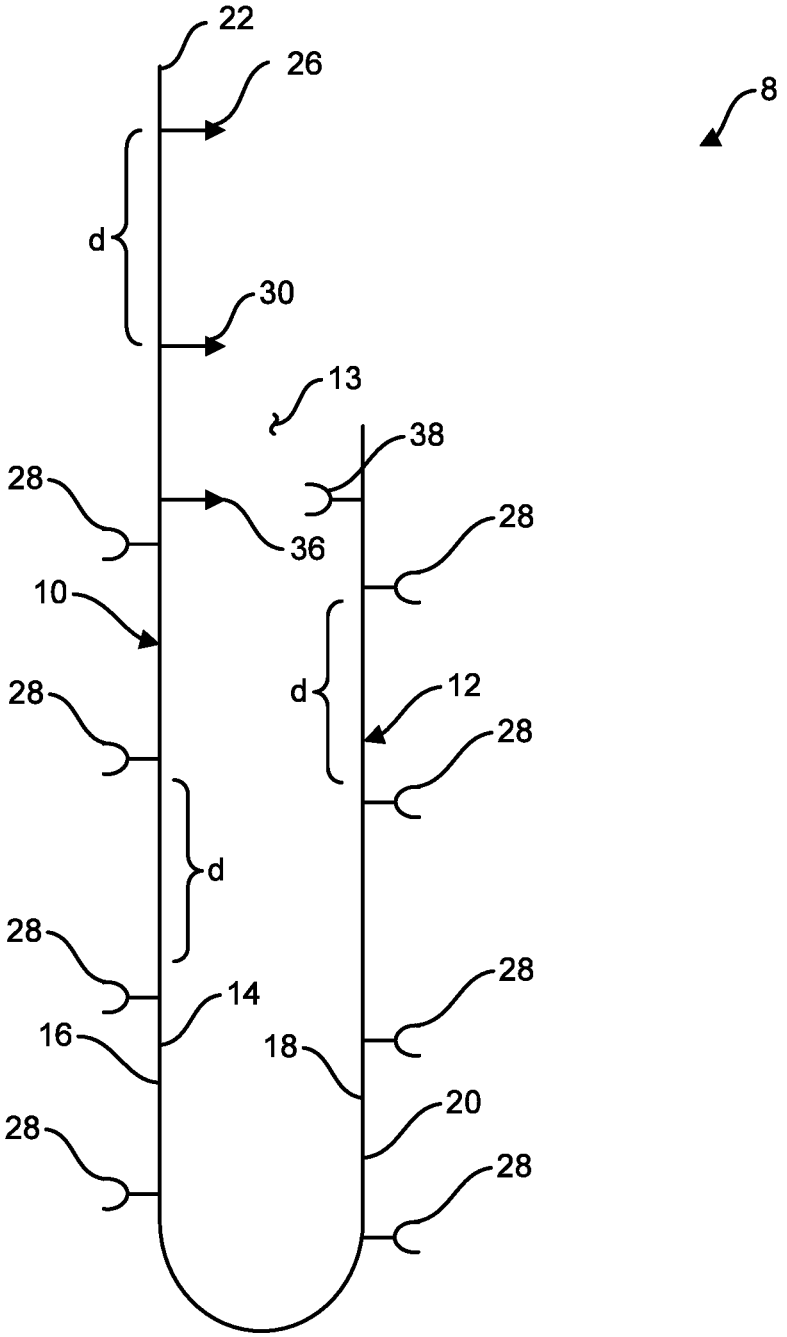
FIG. 1 is a schematic cross section of a polymeric bag shown in an open and upright position.
Figure 2:
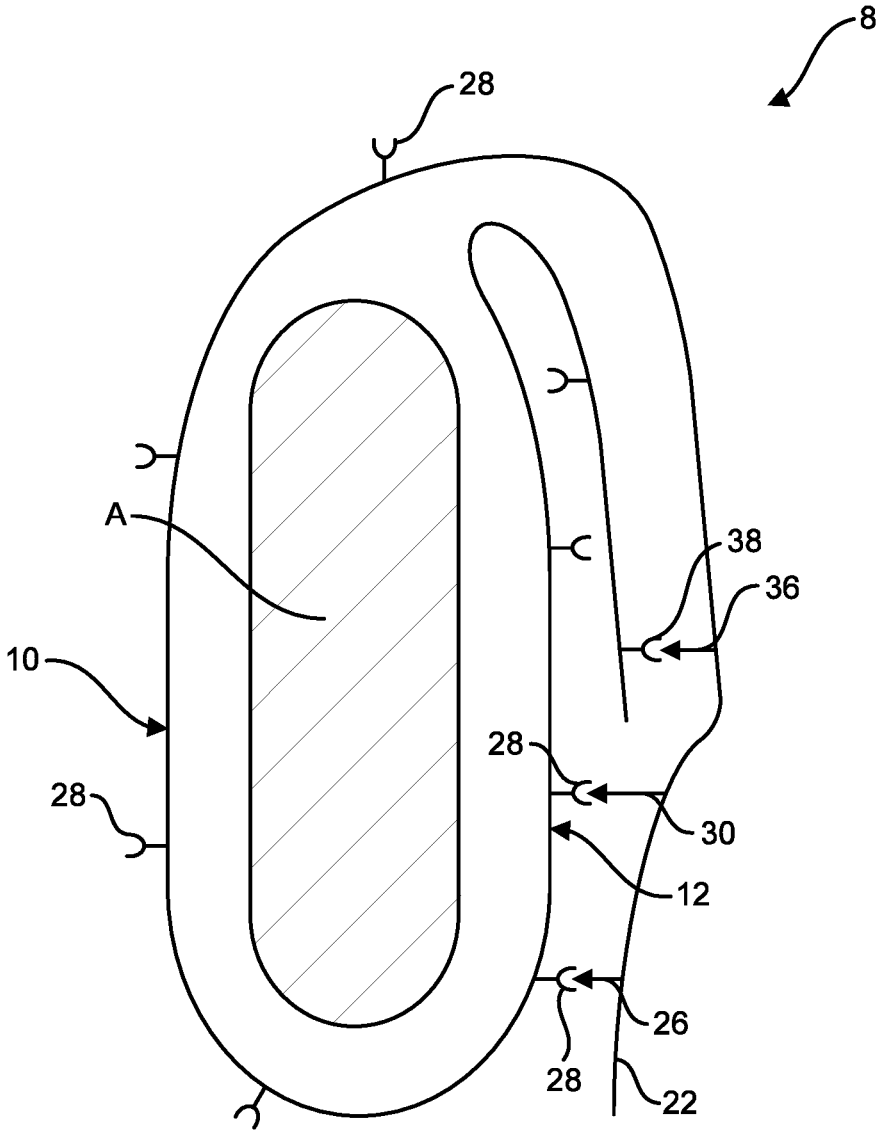
FIG. 2 is a schematic cross section of the polymeric bag of FIG. 1, but showing an article in the bag and the bag in a folded, reduced volume condition.
Figure 3:
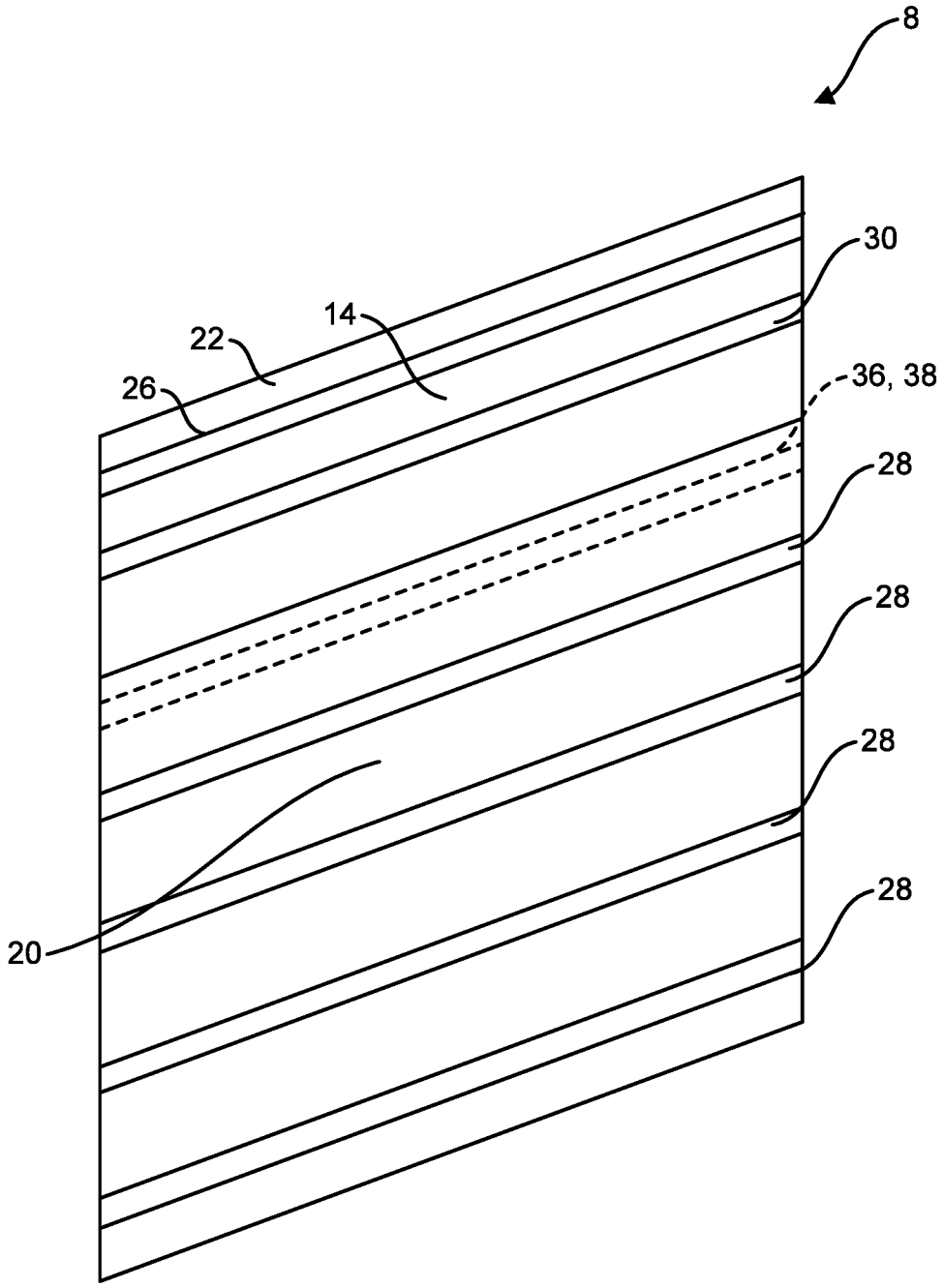
FIG. 3 is a perspective view of the polymeric bag of FIG. 1.

Referring to FIGS. 1-3, a polymeric bag 8 constructed according to the principles of the present invention is shown to comprise a first sheet of polymeric material 10 and a second sheet of polymeric material 12. The first and second sheets 10, 12 are operatively connected together along opposing side edge margins and bottom edge margins to form a bag volume. The upper edge margin of the second sheet 12 is unconnected to the first sheet 10 thereby defining an opening 13 for receiving articles or items into the bag 8. As used herein, an article may be a solid or a liquid. Moreover, the solid can be particulate in configuration. Although the bag is described as including first and second sheets connected together, the connection may be formed using intervening structure, such as gussets (not shown) or other structure. Moreover, the first and second sheets could be part of a single piece of polymeric sheet material that is folded to create the first and second sheets described herein. As shown, the first sheet 10 includes an interior surface 14 and an exterior surface 16. Similarly, the second sheet 12 includes an interior surface 18 and an exterior surface 20. The interior surface 14 of the first sheet 10 faces generally toward the interior surface 18 of the second sheet 12. The first sheet 10 further includes a flap 22 that in the illustrated embodiment is an extension of the remainder of the first sheet 10 that projects above the opening 13.

A first connector element 26 is mounted on the interior surface 14 of the first sheet 10. More specifically, the first connector element 26 is mounted on the flap 22. A plurality of second connector elements 28 are mounted on the exterior surfaces of the second sheet 12 and the first sheet 10. However, the second connector elements 28 could be mounted only on the exterior surface of the second sheet 12 or only on the exterior surface of the first sheet 10. Each of the second connector elements 28 are configured to mate with the first connector element 26. As schematically shown in FIG. 1, the first connector element 26 is a male connector element and the second connector elements 28 are female connector elements. Of course, the gender of the connector elements 26, 28 could be reversed. Moreover, one or both of the connector elements could be a line of adhesive (not shown), rather than a mechanical connector. Preferably, the first and second connector elements 26, 28 are of the re-scalable or re-fastenable type well known to those of ordinary skill in the art. Although re-scalable or re-fastenable connections are preferred, it is possible that one or more of the connector elements could provide for a permanent connection. As shown in FIG. 3, the first and second connector elements 26, 28 extend across the full width of the bag. However, other configurations are possible, including spaced apart connection locations or even a single connection location. A third connector element 30 is mounted on the interior surface of flap 22, and is a male connector element mateable with any one of the second connector elements 28, just like the first connector element 26. The first connector element 26 and the third connector element are spaced apart by a distance d.

The second connector elements 28 are spaced apart along on the exterior surfaces 16, 20 of the first and second sheets 10, 12. In one embodiment, the second connector elements are spaced apart by a distance d, which is the same distance separating the first connector element 26 and the third connector element 30. Beginning at the upper edge margin of the second sheet 12 at the opening 13, the second connector elements 28 are spaced apart on the second sheet 12 at generally equal intervals moving away from the upper edge margin toward the bottom of the bag 8, and then on the exterior surface 16 of the first sheet. The user can select which second connector elements 28 to attach the first and third connector elements 26, 30.

The flap 22 can be folded over the top of the opening so that the first connector element 26 connects with the second connector element nearest the opening 13. In this case, the third connector element 30 remains unconnected. In this configuration, the volume of the bag 8 is essentially at a maximum. However, by selectively mating the first connector 26 to a second connector 28 that is spaced farther from the upper edge of the second sheet 12, the first and second sheets are folded over onto each other and the volume of the bag is reduced. As illustrated in FIG. 2, the bag 8 has received an article A. The first and third connector elements 26, 30 are connected to the fourth and third second connector elements 28 from the upper edge margin of the second sheet 12. The flap 22 and portion of the first sheet 10 fold over to a position to the right (as shown in FIG. 2) of the exterior surface 20 of the second sheet 12. Moreover, the second sheet folds over onto itself. Notably, by making this connection the volume of the bag is reduced to closely correspond to the volume of the article A in the bag. In this way excess air in the bag volume can be forced out, which facilitates keeping the article (e.g., a food item) fresh for a longer period of time. It can be understood that for smaller articles the first and third connectors 26, 30 could be connected to second connectors 28 that are farther away from the upper edge margin of the second sheet 12 to further collapse the volume of the bag 8. For purposes of this description, distance from the upper edge margin is measured downwardly from the upper edge of the second sheet 12, around the bottom of the bag 8 and upward to the upper edge margin of the flap 22 (as shown in FIG. 1).

In addition to the first, second and third connector elements 26, 28, 30, the bag 8 further includes an opening closure comprising a first opening closure element 36 and a second opening closure element 38. The opening closure as shown in the figures is a re-scalable or re-fastenable closure of the same type as the first, second and third connector elements 26, 28, 30. However, it will be understood that other types of closures could be used. As shown, the first opening closure element 36 is a male element and the second opening closure element is a female element. Again, the gender could be reversed within the scope of the present invention. Moreover, the opening closure could be omitted. The first and second opening closure elements 36, 38 are positioned near the opening 13 in the bag 8. Connection of the first and second opening closure elements 36, 38 provides for closure of the opening 13 independent of any connection of the first and/or third connector elements 26, 30 to the second connector element(s) 28. In one embodiment the first and second opening closure elements 36, 38 are closed after the first and/or third connector elements 26, 30 are connected to one or more second connector elements 28 so that air can be forced out of the bag volume. It is also conceived that that a port or vent could be provided so that air is allowed out of the bag 8 as it is folded from, for example, the position shown in FIG. 1 to the position shown in FIG. 2.

Figure 4:
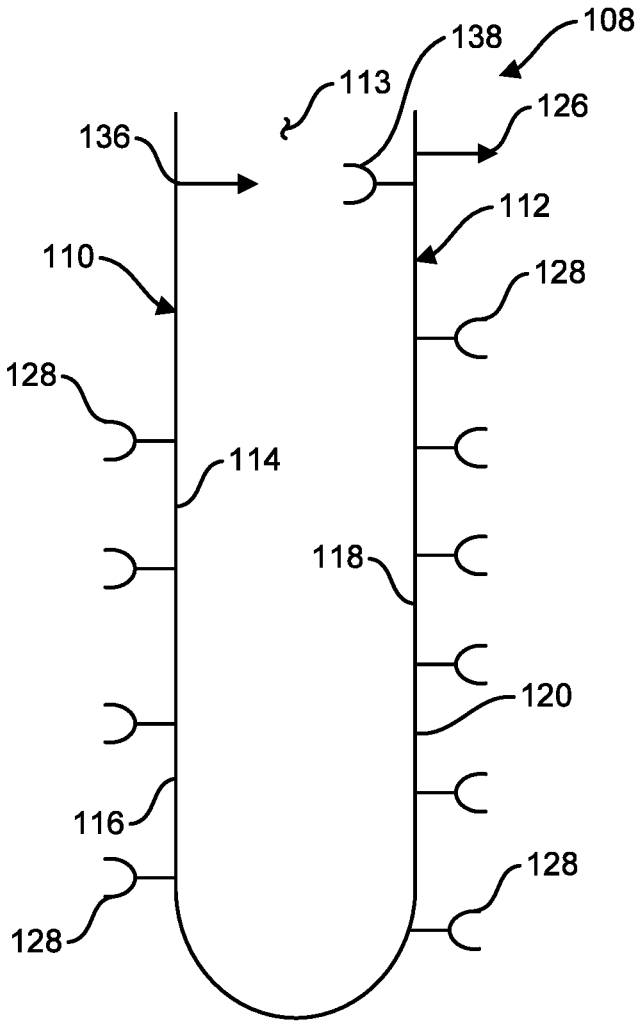
FIG. 4 is a schematic cross section of another version of the polymeric bag.

Referring now to FIG. 4, a bag 108 of a different version is shown. The bag 108 is very similar in construction to the bag 8 of FIGS. 1-3. Accordingly, corresponding parts of the bag 108 will be given the same reference numerals as those parts had for bag 8, plus "100". The bag 108 has a first sheet 110 of polymeric material and a second sheet 112 of polymeric material having interior surfaces 114, 118 that face each other and define the bag volume. The bag 108 does not have a flap like the flap 22 of bag 8. A first (male) connector element 126 is located on an exterior surface 120 of the second sheet 112 near an opening 113 of the bag 108. Additional male connector elements could be provided. Second connector elements 128 are mounted on the exterior surface 120 of the second sheet 112 and also on an exterior surface 116 of the first sheet 110. It will be understood that the second connector elements 128 could be located only on the exterior surface of the second sheet 112, or only on the exterior surface 116 of the first sheet 110.

The bag 108 further includes an opening closure comprising a first opening closure element 136 and a second opening closure element 138. These elements are located opposite each other on the interior surfaces 114, 118 of the first and second sheets 110, 112. As in the first version, the first and second closure elements 136, 138 can be mated to close the opening 113 of the bag 108. It will be understood that in this version, no closure of the opening 113 is ordinarily made by connection of the first connector element 126 to one of the second connector elements 128. However, it will be understood that air can be evacuated from the volume of the bag 108 by folding the first and second sheets 110, 112 in the same manner as shown in FIG. 2 for the first version of the bag 8. Folding of the first and second sheets 110, 112 collapses the volume of the bag 108 and connection of the first connector element 126 to a selected one of the second connector elements holds that volume.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. A selectively sizeable polymeric bag comprising:

a first sheet of polymeric material having an interior surface and an exterior surface;

a second sheet of polymeric material having an interior surface and an exterior surface, the second sheet of polymeric material being arranged so that the interior surface of the second sheet of polymeric material faces toward the interior surface of the first sheet of polymeric material, the second sheet of polymeric material being operatively connected to the first sheet of material to form a bag volume, the first and second sheets of material having an opening at one end for receiving items into the bag volume;

a first closure element on an interior surface of the first sheet of polymeric material proximate the opening;

a second closure element on an interior surface of the second sheet of polymeric material proximate the opening, the second closure element having a different configuration from the first closure element and being selectively mateable with the first closure element for closing the opening;

a first connector element located on the exterior surface of the second sheet of polymeric material;

second connector elements, at least one of the second connector elements being located on the exterior surface of the first sheet of polymeric material and at least one of the second connector elements being located on the exterior surface of the second sheet of polymeric material when the bag is configured to have a maximum volume, the first connector element being configured for selective connection to any one of the second connector elements, the second connector elements being arranged so that the bag volume changes upon connection of the first connector element to different ones of the second connector elements.

2. The polymeric bag as set forth in claim 1 wherein the second connector elements are mounted on the exterior surface of the second sheet of polymeric material.

3. The polymeric bag as set forth in claim 1 wherein the second connector elements are mounted on the exterior surface of the first sheet of polymeric material.

4. The polymeric bag as set forth in claim 1 wherein a plurality of the second connector elements are mounted on both the exterior surface of the first sheet of polymeric material and the exterior surface of the second sheet of polymeric material.

5. The polymeric bag as set forth in claim 1 wherein the second connector elements are spaced apart from each other along a path extending from the opening toward an end of the bag opposite the opening on the second sheet of polymeric material and thence from the opposite end of the bag to the opening on the first sheet of polymeric material.

6. The polymeric bag as set forth in claim 1 wherein the first and second sheets of polymeric material have side edges joined together, the first connector element and each of the second connector elements extending from one side edge to the other side edge of the first and second sheets of polymeric material.

7. The polymeric bag as set forth in claim 1 wherein the second sheet has an upper edge located at the opening in the bag, and the first connector element is located below the upper edge of the second sheet.

8. The polymeric bag as set forth in claim 7 wherein the first connector element is one of a male connector element and a female connector element, and the second connector elements are each the other of the male connector element and the female connector element.

9. A selectively sizable polymeric bag comprising:

a first sheet of polymeric material having an interior surface and an exterior surface;

a second sheet of polymeric material having an interior surface and an exterior surface, the second sheet of polymeric material being arranged so that the interior surface of the second sheet of polymeric material faces toward the interior surface of the first sheet of polymeric material, the second sheet of polymeric material being operatively connected to the first sheet of material to form a bag volume, the first and second sheets of material having an opening at one end for receiving items into the bag volume;

a first closure element on an interior surface of the first sheet of polymeric material proximate the opening;

a second closure element on an interior surface of the second sheet of polymeric material proximate the opening, the second closure element having a different configuration from the first closure element and being selectively mateable with the first closure element for closing the opening;

a first connector element located on the exterior surface of the second sheet of polymeric material;

second connector elements located on the exterior surface of at least one of the first and second sheets of polymeric material, the first connector element being configured for selective connection to any one of the second connector elements, the second connector elements being arranged so that the bag volume changes upon connection of the first connector element to different ones of the second connector elements;

the second connector elements being spaced apart from each other along a path extending from the opening toward an end of the bag opposite the opening on the second sheet of polymeric material and thence from the opposite end of the bag to the opening on the first sheet of polymeric material.

10. A selectively sizable polymeric bag comprising:

a first sheet of polymeric material having an interior surface and an exterior surface;

a second sheet of polymeric material having an interior surface and an exterior surface, the second sheet of polymeric material being arranged so that the interior surface of the second sheet of polymeric material faces toward the interior surface of the first sheet of polymeric material, the second sheet of polymeric material being operatively connected to the first sheet of material to form a bag volume, the first and second sheets of material having an opening at one end for receiving items into the bag volume;

a first closure element on an interior surface of the first sheet of polymeric material proximate the opening;

a second closure element on an interior surface of the second sheet of polymeric material proximate the opening, the second closure element having a different configuration from the first closure element and being selectively mateable with the first closure element for closing the opening;

a first connector element located on the exterior surface of the second sheet of polymeric material;

second connector elements located on the exterior surface of at least one of the first and second sheets of polymeric material, the first connector element being configured for selective connection to any one of the second connector elements, the second connector elements being arranged so that the bag volume changes upon connection of the first connector element to different ones of the second connector elements;

the first and second sheets of polymeric material have side edges joined together, the first connector element and each of the second connector elements extending from one side edge to the other side edge of the first and second sheets of polymeric material.

* * * * *